US009004983B2

(12) United States Patent
Cady et al.

(10) Patent No.: US 9,004,983 B2
(45) Date of Patent: Apr. 14, 2015

(54) POLISHING PAD FOR POLISHING SEMICONDUCTOR SURFACES

(71) Applicant: Corning Incorporated, Corning, NY (US)

(72) Inventors: Raymond Charles Cady, Horseheads, NY (US); Michael John Moore, Corning, NY (US); Mark Alex Shalkey, Corning, NY (US); Mark Andrew Stocker, Holcot (GB)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 13/955,683

(22) Filed: Jul. 31, 2013

(65) Prior Publication Data

US 2013/0316631 A1 Nov. 28, 2013

Related U.S. Application Data

(62) Division of application No. 13/048,399, filed on Mar. 15, 2011, now Pat. No. 8,500,934, which is a division of application No. 11/967,818, filed on Dec. 31, 2007, now Pat. No. 7,927,092.

(51) Int. Cl.

| | |
|---|---|
| ***B24B 37/26*** | (2012.01) |
| ***B24B 13/02*** | (2006.01) |
| ***B24B 37/20*** | (2012.01) |
| ***B24D 18/00*** | (2006.01) |

(52) U.S. Cl.

CPC ..... *B24B 37/26* (2013.01); *B24B 13/02* (2013.01); *B24B 37/20* (2013.01); *B24D 18/0009* (2013.01)

(58) Field of Classification Search

CPC ..... B24B 37/26; B24B 13/02; B24D 3/00
USPC ..... 451/527, 548, 550
See application file for complete search history.

(56) References Cited

U.S. PATENT DOCUMENTS

| | | | | |
|---|---|---|---|---|
| 2,245,874 A | | 6/1941 | Robinson | |
| 3,128,322 A | | 4/1964 | Young | 264/314 |
| 3,322,598 A | | 5/1967 | Marks | 156/382 |
| 3,583,111 A | * | 6/1971 | Volk | 451/490 |
| 3,699,721 A | * | 10/1972 | Beasley | 451/550 |
| 4,274,232 A | * | 6/1981 | Wylde | 451/490 |

(Continued)

FOREIGN PATENT DOCUMENTS

| | | | |
|---|---|---|---|
| CN | 1846940 A | 10/2006 | B24D 99/00 |
| JP | 2006324498 | 11/2006 | H01L 21/304 |
| KR | 2004051837 | 12/2002 | H01L 21/304 |

*Primary Examiner* — Timothy V Eley
(74) *Attorney, Agent, or Firm* — Ryan T. Hardee

(57) ABSTRACT

Methods and apparatus for forming a semi-spherical polishing pad for polishing semiconductor surfaces, provide for: placing a polishing pad pre-form on a dome-shaped forming surface, the polishing pad pre-form including a circular body having a center and an outer peripheral edge, and a plurality of slots extending from the outer peripheral edge towards the center; disposing a bladder opposite to the dome-shaped forming surface and the polishing pad pre-form; inflating the bladder with a fluid such that the dome-shaped forming surface of the bonnet form presses against the polishing pad pre-form from one side and the bladder presses against the polishing pad pre-form from an opposite side; and maintaining the pressing step for a predetermined period of time to achieve the semi-spherical polishing pad.

6 Claims, 6 Drawing Sheets

(56) References Cited

U.S. PATENT DOCUMENTS

| | | | | |
|---|---|---|---|---|
| 4,564,408 | A | 1/1986 | Crumbach et al. | 156/212 |
| 5,374,564 | A | 12/1994 | Bruel | 437/24 |
| 5,384,988 | A * | 1/1995 | Hernandez | 451/42 |
| 5,851,138 | A | 12/1998 | Hempel | |
| 6,089,963 | A * | 7/2000 | Wiand et al. | 451/390 |
| 6,361,409 | B1 | 3/2002 | Vishwanathan et al. | |
| 6,599,175 | B2 | 7/2003 | Herb et al. | |
| 6,942,550 | B2 * | 9/2005 | Sangster et al. | 451/42 |
| 7,176,528 | B2 | 2/2007 | Couillard et al. | 257/347 |
| 2004/0129576 | A1 | 7/2004 | Makino et al. | |

* cited by examiner

50

50

POLISHING PAD FOR POLISHING SEMICONDUCTOR SURFACES

This application is a divisional application of and claims the priority benefit of U.S. patent application Ser. No. 13/048,399, now U.S. Pat. No. 8,500,934, filed on Mar. 15, 2011 which is a divisional application of and claims the priority benefit of U.S. patent application Ser. No. 11/967,818, filed on Dec. 31, 2007, now U.S. Pat. No. 7,927,092, the content of each being relied upon and incorporated herein by reference in their entirety.

BACKGROUND

The present invention relates to a new slurry pad configuration, such as those used to polish semiconductor devices, to methods of manufacturing same, and to an apparatus used in such manufacture.

Semiconductor devices, such as, but not limited to, semiconductor-on-insulator (SOI) structures are prepared such that a relatively flat semiconductor layer is available, on which electronic components are formed. SOI technology is becoming increasingly important for use in displays, including organic light-emitting diode (OLED) displays, liquid crystal displays (LCDs), active matrix displays, integrated circuits, photovoltaic devices, thin film transistor applications, etc.

The semiconductor material most commonly used in semiconductor-on-insulator structures has been silicon. SOI structures may include a thin layer of substantially single crystal silicon (generally 0.05-0.3 microns in thickness but, in some cases, as thick as 5 microns) on an insulating material. The state of the art processes for forming TFTs on polysilicon result in silicon thicknesses on the order of about 50 nm.

As will be discussed later herein, the silicon layer thickness may adjusted through controlling the process parameters of bonding the silicon layer onto the substrate (e.g., a glass or glass-ceramic substrate). In display applications, the silicon layer thickness is typically in the 50-150 nm range. In addition to silicon layer thickness, the surface roughness of the silicon layer is critical to obtaining high performance TFTs. Surface roughness is typically in the 1-10 nm range just after bonding the silicon layer to the substrate (a so-called "as fabricated" SOI). Thus, post processes are typically carried out to reduce the semiconductor (silicon) layer thickness and to reduce the layer roughness. These processes will be discussed below.

The SOI abbreviation is used herein to refer to semiconductor-on-insulator structures in general, including, but not limited to, silicon-on-insulator structures. Similarly, the SiOG abbreviation may be used to refer to semiconductor-on-glass structures in general, including, but not limited to, silicon-on-glass and/or silicon on glass-ceramic structures. SOI structures encompass SiOG structures.

Various ways of obtaining SOI structures include epitaxial growth of silicon (Si) on lattice matched substrates. An alternative process includes the bonding of a single crystal silicon wafer to another silicon wafer on which an oxide layer of $SiO_2$ has been grown, followed by polishing or etching of the top wafer down to, for example, a 0.05 to 0.3 micron layer of single crystal silicon. Further methods include ion-implantation methods in which either hydrogen or oxygen ions are implanted either to form a buried oxide layer in the silicon wafer topped by Si in the case of oxygen ion implantation or to separate (exfoliate) a thin Si layer to bond to another Si wafer with an oxide layer as in the case of hydrogen ion implantation.

The former two methods have not resulted in satisfactory structures in terms of cost and/or bond strength and durability. The latter method involving hydrogen ion implantation has received some attention and has been considered advantageous over the former methods because the implantation energies required are less than 50% of that of oxygen ion implants and the dosage required is two orders of magnitude lower.

U.S. Pat. No. 5,374,564 discloses a process to obtain a single crystal silicon film on a substrate using a thermal process. A silicon wafer having a planar face is subject to the following steps: (i) implantation by bombardment of a face of the silicon wafer by means of ions creating a layer of gaseous micro-bubbles defining a lower region of the silicon wafer and an upper region constituting a thin silicon film; (ii) contacting the planar face of the silicon wafer with a rigid material layer (such as an insulating oxide material); and (iii) a third stage of heat treating the assembly of the silicon wafer and the insulating material at a temperature above that at which the ion bombardment was carried out. The third stage employs temperatures sufficient to bond the thin silicon film and the insulating material together, to create a pressure effect in the micro-bubbles, and to cause a separation between the thin silicon film and the remaining mass of the silicon wafer. (Due to the high temperature steps, this process does not work with lower cost glass or glass-ceramic substrates.)

U.S. Pat. No. 7,176,528 discloses a process that produces an SiOG structure. The steps include: (i) exposing a silicon wafer surface to hydrogen ion implantation to create a bonding surface; (ii) bringing the bonding surface of the wafer into contact with a glass substrate; (iii) applying pressure, temperature and voltage to the wafer and the glass substrate to facilitate bonding therebetween; and (iv) cooling the structure to a common temperature to facilitate separation of the glass substrate and a thin layer of silicon from the silicon wafer.

By adjusting the implant energy, the semiconductor (e.g., silicon) layer thickness may be reduced to 300-500 nm if there is no oxide on the silicon surface before implantation, which is desirable for the SiOG process. From 300-500 nm, the thickness of the layer should be reduced to less than about 100 nm.

The resulting SOI structure just after exfoliation might exhibit surface roughness (e.g., about 10 nm or greater), excessive silicon layer thickness (even though the layer is considered "thin"), and implantation damage of the silicon layer (e.g., due to the formation of an amorphized silicon layer). The amorphized silicon layer may be anywhere from 50-150 nm in thickness and should be removed to obtain desired electronic properties for the later formed electronic components.

Chemical mechanical polishing (CMP) is a typical process to reduce the thickness of the silicon layer, to reduce the roughness of the silicon layer, and to remove the amorphized silicon layer after the silicon layer has been exfoliated from the donor silicon wafer. CMP for the SiOG structure application is accomplished using abrasive slurries coupled with a textile polishing pad (which is sometimes fibrous) saturated with such abrasive slurry. The slurry is a mixture of abrasive particles and a liquid carrier, which may be de-ionized water. The polishing pad is bonded (via adhesive) to a rotating platen. The SOI structure to be polished and the polishing pad are subjected to a stream of pumped slurry, and the polishing action is accomplished by forcing the abrasive charged polishing pad against the semiconductor material of the SOI, resulting in material removal and subsequent polishing of the semiconductor surface.

In most cases, both the platen and SOI structure to be polished are in a flat configuration. The polishing pad is formed and assembled to the platen such that the resulting pad surface is smooth and uniform, with no wrinkles or surface irregularities, which would otherwise create problems with the polishing uniformity. In the case of a flat polishing pad, it is a relatively straight forward task to cut and mount the pad to a flat polishing platen. The form of the pad is cut to conform to the contour of the platen (which is flat), and the pad is bonded to the platen with a pressure sensitive adhesive. In most cases, the polishing pads and the platens (and bonnets thereof) are of flat, circular geometry.

In more recent developments, the polishing pad is mounted on a semi-spherical bonnet that allows tangent tool contact polishing of spherical shapes such as lenses. The tangent tool contact processes can also be used to polish flat surfaces, such as SOI structures. This is commonly performed by deterministic polishing, an abrading process in which the contact area of the polishing pad is substantially smaller that the area of the SOI structure needing polishing. The material removal process is performed by rotating the bonnet (and attached polishing pad) and simultaneously moving it in a predetermined scanning pattern along the contour of the semiconductor layer of the SOI. Although different scanning patterns are available, the most common pattern is a series of closely spaced parallel lines (a raster), similar to the line pattern scanned on a cathode ray tube of a traditional television set.

The requirements for SOI thinning and roughness reduction are quite stringent. It would be desirable for the final semiconductor layer thickness to be controlled with an accuracy of about ±8 nm. The radius of curvature of the semi-spherical bonnet introduces a challenge as to mounting a flat polishing pad firmly to the radiused bonnet in a smooth fashion with no wrinkles that would adversely effect the polishing process. Wrinkles and/or other polishing pad irregularities may adversely effect the polishing process just as deviations in the rotation of the bonnet have a profound effect on material removal. It will be appreciated that any eccentricity in the polishing pad rotation (from the bonnet itself, wrinkles in the pad, registration problems, etc.) will result in thickness variability in the semiconductor layer. It has been found that bonnet eccentricity alone can result in thickness variability of about 15 nm, which is larger than the desired layer thickness tolerance. Additional irregularities from wrinkles in the polishing pad may significantly increase the variability.

The conventional technique for forming semi-spherical polishing pads is to cut a circle from sheet material, soften the material with acetone (or a similar solvent), and then press the pad in a two-part mold. The mold includes a bottom mold section having a convex surface and a top mold section having a corresponding concave surface. FIG. 1 illustrates the prior art semi-spherical pad 10 after the top mold has been removed. Note the wrinkles 12 at the peripheral edge of the pad 10.

In view of the foregoing, there is a need in the art for new methods and apparatus for producing a semi-spherical polishing pad.

SUMMARY

In accordance with one or more embodiments, the geometry of a polishing pad includes an outside diameter to fit the dimensions of an existing semi-spherical bonnet, and an inside diameter defining a central aperture. A set of equally spaced radial slots on the outside diameter of the pad allows material relief, eliminating material gathering once molded and attached to the bonnet. This reduces material wrinkles and allows for a smoother fit. The central aperture of the pad allows more material flexibility in the pad reducing wrinkles and also provides a feature that allows a referencing button (fabricated of a material that is harder than the pad material) to be placed on the bonnet, which is used to set the tool axis position in relation to the surface to be polished.

Prior to forming, the polishing pad is conditioned by rolling it over an edge (such as an edge of a tabletop) in multiple radial directions, yielding the pad fibers, reducing material memory, and allowing the pad to become more flexible and compliant to the convex shape of the bonnet. The pad material is saturated with solvent to make it more flexible and compliant, and then pressed over the bonnet form (as the bottom mold section). A flexible bladder, air-filled pneumatic bladder is pressed onto the pad opposite the bonnet form, which when inflated to pressure, allows an even pneumatic force to be applied to the pad. The pressing technique allows uniform compliance of the pad to the bonnet form, yielding less pad irregularity, and greater polishing precision and predictability.

In accordance with one or more embodiments of the present invention, a polishing pad for polishing semiconductor surfaces, includes a circular body having a center and an outer peripheral edge; and a plurality of slots extending from the outer peripheral edge towards the center. The body is in a semi-spherical, domed shape.

The plurality of slots may include a width that is substantially constant along a length thereof when the polishing pad is in a flat orientation. Alternatively, the width may taper along a length thereof from the peripheral edge toward the center when the polishing pad is in a flat orientation. When 12 slots are employed, they may be disposed evenly about the perimeter of the body, each at an angle of about 30 degrees from one another. When 6 slots are employed they may be disposed evenly about the perimeter of the body, each at an angle of about 60 degrees from one another.

The polishing pad may include an aperture disposed at the center of the body.

In accordance with one or more further embodiments of the present invention, an apparatus for forming a semi-spherical polishing pad for polishing semiconductor surfaces includes: a first platen; a bonnet form, coupled to the first platen and having a dome-shaped forming surface directed away from the first platen and operable to receive a polishing pad pre-form; a second platen spaced apart from the first platen; a bladder coupled to the second platen and facing the dome-shaped forming surface of the bonnet form; and a press mechanism coupled to the first and second platens and operable to urge the first and second platens toward one another to facilitate engagement of the bladder against the polishing pad pre-form.

The press mechanism is operable to move the second platen a distance toward the first platen to dispose the bladder at a predetermined distance from the dome-shaped forming surface of the bonnet form. The press mechanism may include one or more clamps that lock the first and second platens such that the bladder is at the predetermined distance.

The bladder is operable to impart a controllable force in response to variations in fluid pressure such that the dome-shaped forming surface of the bonnet form presses against the polishing pad pre-form from one side and the bladder presses against the polishing pad pre-form from an opposite side. The fluid may be a liquid or a gas, such as air.

The use of the apparatus includes: placing a polishing pad pre-form on a dome-shaped forming surface; disposing the bladder opposite to the dome-shaped forming surface and the polishing pad pre-form; inflating the bladder with a fluid such that the dome-shaped forming surface of the bonnet form presses against the polishing pad pre-form from one side and the bladder presses against the polishing pad pre-form from an opposite side; and maintaining the pressing step for a predetermined period of time to achieve the semi-spherical polishing pad. The pressure within the bladder may be increased to about 1 Bar during the inflating step. Prior to placing the polishing pad pre-form on the dome-shaped forming surface, the pad pre-form may be rolled and/or dragged over a straight edge in multiple radial directions such that material fibers of the polishing pad pre-form yield and the polishing pad pre-form becomes more flexible. Additionally or alternatively, the pad pre-form may be soaked with a solvent such that the polishing pad pre-form becomes more flexible.

Other aspects, features, advantages, etc. will become apparent to one skilled in the art when the description of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION

Figure 1:
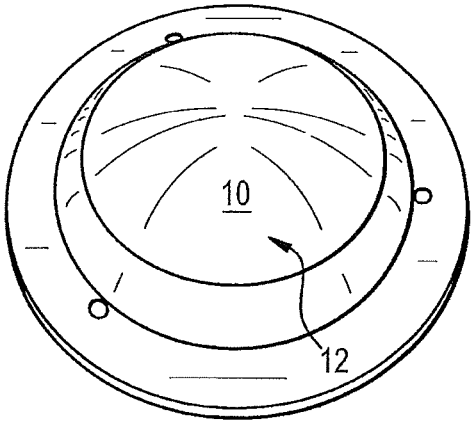
FIG. 1 is a perspective view of a polishing pad in accordance with the prior art.
Figure 2:
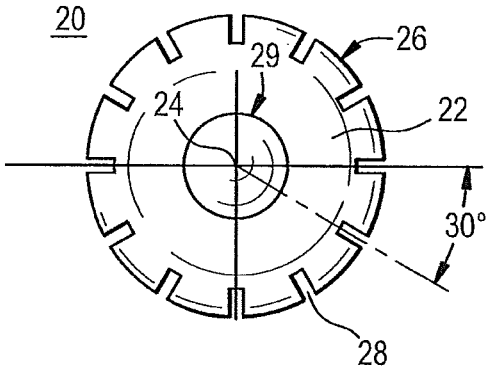
FIG. 2 is a top, schematic view of a pre-form cut out for a polishing pad in accordance with one or more embodiments of the present invention.

With reference to the drawings, wherein like numerals indicate like elements, there is shown in FIG. 2 a polishing pad pre-form 20 for use in tangent tool contact polishing of spherical shapes, such as lenses, flat surfaces, such as SOI structures, etc. Although the polishing pad pre-form 20 is flat, after a forming process a semi-spherical, domed-shape will result, which is the intended configuration for the tangent tool contact polishing. The polishing pad pre-form 20 includes a circular body 22 having a center 24, and an outer peripheral edge 26. The specific material of the pad pre-form 20 may be selected from any of the known materials and suppliers.

A plurality of slots 28 extend from the outer peripheral edge 26 radially towards the center 24. As will be discussed in more detail below, the slots 28 allow material relief, eliminating material gathering once the pad pre-form 20 is molded and attached to a bonnet of the tangent tool (not shown). This reduces material wrinkles and allows for a smoother fit. In the embodiment illustrated in FIG. 2, the slots 28 each include a width that is substantially constant along a length thereof. In this embodiment, the plurality of slots 28 are disposed evenly about the peripheral edge 26 of the body 22 such that the slots 28 are at an angle of about 30 degrees from one another.

The specifics of the slot 28 details of this embodiment may be expressed in several ways, such as absolute dimensions, relative dimensions, etc. For example, the width of the slots 28 may be about 0.1 to about 0.4 inches, while the length of the slots 28 may be about 0.25 to about 0.5 inches. In relative terms, the width of the slots may be about 20%-160% of the length thereof. Relative to the diameter of the body 22, the width of the slots may be about 2% to about 10% of the diameter, while the length of the slots may be about 6% to about 15% of the diameter. In this particular configuration, the diameter of the body 22 is about 4 inches (although it is understood that other diameters are contemplated.

An aperture 29 is disposed at the center 24 of the body 22 and is preferably of circular configuration. The dimensions of the aperture 29 may be expressed in absolute or relative terms. For example, a diameter of the aperture may be about 0.5-1.0 inches, or about 15%-25% of the diameter of the body 22. The removal of material from the center 24 of the pad pre-form 20 allows more material flexibility in the body 22, which reduces wrinkles in the final formed pad (which will be discussed in more detail below).

Figure 3:
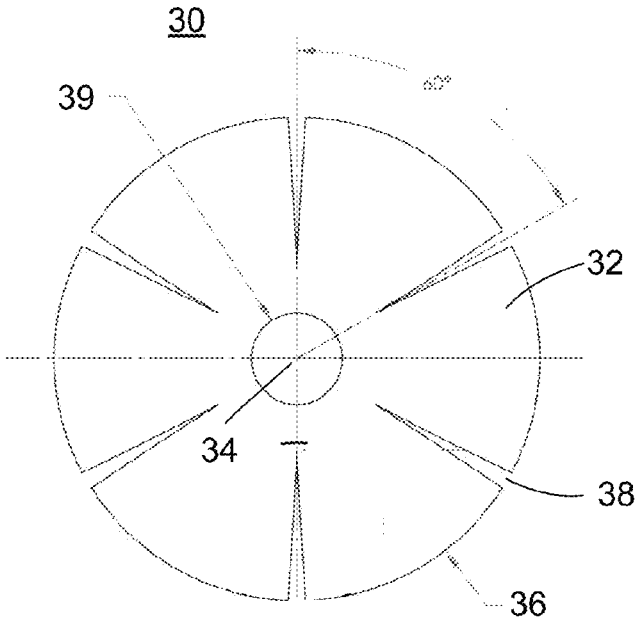
FIG. 3 is a top, schematic view of a pre-form cut out for an alternative polishing pad in accordance with one or more further embodiments of the present invention.

With reference to FIG. 3, an alternative polishing pad pre-form 30 is illustrated, again for use in tangent tool contact polishing. Again, although the polishing pad pre-form is flat, after a forming process a semi-spherical, domed-shape will result. The polishing pad pre-form 30 includes a circular body 32 having a center 34, and an outer peripheral edge 36. Again, a plurality of slots 38 extend from the outer peripheral edge 36 radially towards the center 34. In this embodiment, the slots 38 each include a width that tapers along a length thereof from the peripheral edge 36 toward the center 34 when the polishing pad pre-form 30 is in a flat orientation. In this embodiment, the plurality of slots 38 are disposed evenly about the peripheral edge 36 of the body 32 such that the slots 38 are at an angle of about 60 degrees from one another.

The details of the slots 38 of this embodiment of the pad pre-form 30 include that the width of the slots 38 are about 0.1 to about 0.4 inches at the peripheral edge 36 (e.g., when the diameter of the pad perform is about 4 inches). The length of the slot 38 may be about 0.5-1.5 inches. The slots 38 may taper to a point, be rounded, or may be cut straight across. In relative terms, the width of the slots 38 at the peripheral edge 36 may be about 6%-80% of the length thereof. With respect to the diameter of the body 32, the width of the slots 38 at the peripheral edge may be about 2% to about 10% of the diameter, and the length of the slots 38 may be about 12% to about 40% of the diameter.

Figure 4:
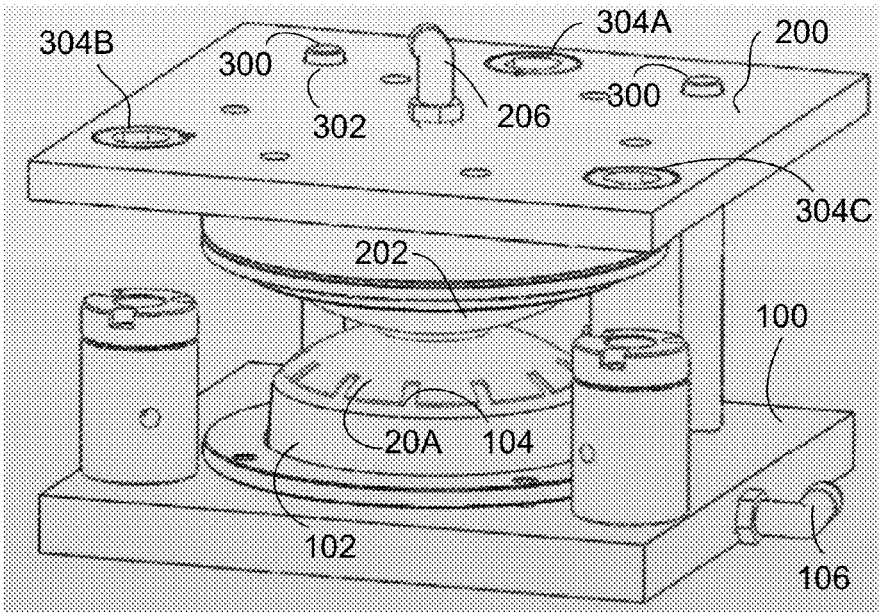
FIGS. 4, 5, and 6 are perspective, and partial cut away views of an apparatus for forming a polishing pad in accordance with one or more embodiments of the present invention.
Figure 5:
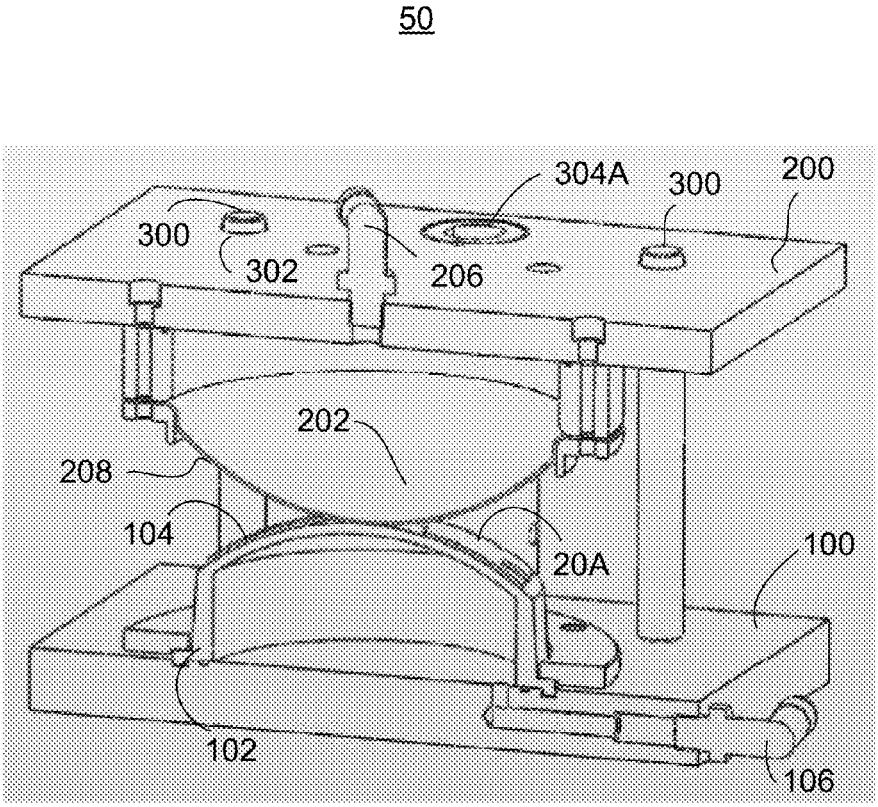
Figure 6:
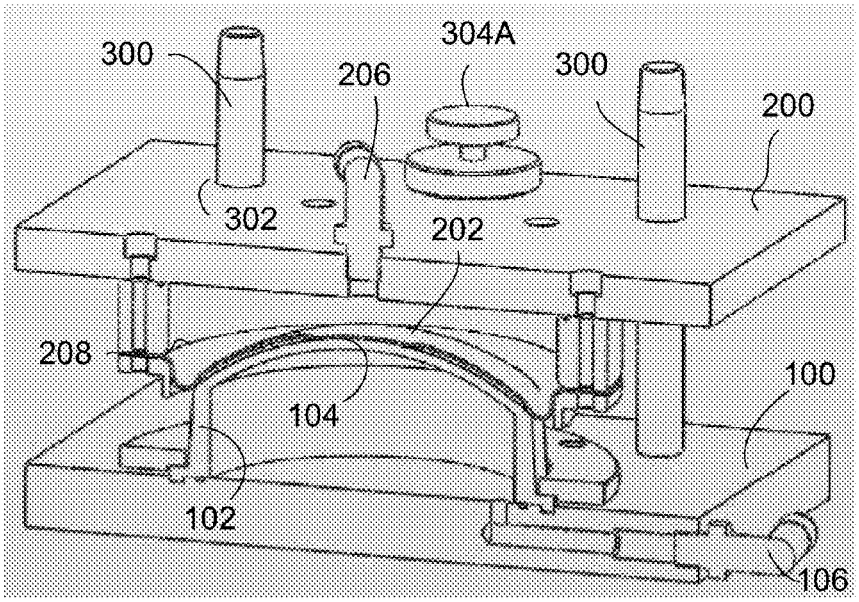

FIGS. 4-6 illustrate an apparatus 50 for forming a semi-spherical polishing pad 20A from pad pre-forms, such as the pad perform 20 or the pad pre-form 30 discussed above. The apparatus 50 includes first and second platens 100, 200 that are spaced apart from one another. The second platen 200 is moveable relative to the first platen 100 (although in other embodiments this function may be reversed or both platens may be movable). The first platen 100 is operable to releasably receive a bonnet form 102. The bonnet form 102 includes a dome-shaped forming surface 104 directed away from the first platen 100 and operable to receive the polishing pad pre-form 20.

The second platen 200 is operable to receive a bladder 202 that faces the dome-shaped forming surface 104 of the bonnet form 102. An inflation port 206 communicates with an interior volume of the bladder 202 to deliver and remove a fluid (a liquid or a gas, such as air) therefrom. As best seen from the cross-sectional view of FIG. 5, the bladder 202 includes an engagement surface 208 that presses against the pad pre-form 20, 30 to varying degrees as the pressure in the bladder 202 increases. When the platens 100, 200 are spaced far apart (as in FIGS. 4 and 5), the engagement surface 208 of the bladder 202 achieves a convex shape, as would be expected in a balloon-type device.

The apparatus 50 includes a press mechanism that is operable to move the second platen 200 a distance toward the first platen 100 to dispose the bladder 202 at a predetermined distance from the dome-shaped forming surface 104 of the bonnet form 102. The press mechanism includes one or more alignment rods 300, fixed in the first platen 100 and slideably received in apertures 302 of the second platen 200. The press mechanism also includes one or more clamps 304A, 304B, 304C, fixed in the first platen 100, that engage the second platen 200 (via complementary mechanisms) and lock the first and second platens 100, 200 such that the bladder 202 is at the predetermined distance. The locks 304 may be implemented using threaded bolts and complementary threaded posts.

When the platens 100, 200 are spaced close to one another (as in FIG. 6), the engagement surface 208 of the bladder 202 presses against the polishing pad pre-form 20, 30. The shape of the bladder 202 (and the engagement surface 208 thereof) reverses from the convex to concave, to complement the shape of the dome-shaped forming surface 104 of the bonnet form 102 and the pad pre-form 20, 30. In response to varying quantities and/or pressures of the fluids introduced through the port 206, the bladder 202 is operable to impart a controllable force such that the dome-shaped forming surface 104 of the bonnet form 102 presses against the polishing pad pre-form 20, 30 from one side and the engagement surface 208 of the bladder 202 presses against the polishing pad pre-form 20, 30 from an opposite side. The pressure within the bladder 202 may be increased to about 1 Bar to provide sufficient force (for a predetermined time) to achieve the dome-shaped pad.

Prior to placing the polishing pad pre-form 20, 30 on the dome-shaped forming surface 104 of the bonnet form 102, the pad perform 20, 30 may be rolled and/or dragged over a straight edge in multiple radial directions such that material fibers of the polishing pad pre-form 20, 30 yield and the polishing pad pre-form 20, 30 becomes more flexible. Additionally or alternatively, prior to placement of the pad pre-form 20, 30 on the dome-shaped forming surface 104, the polishing pad pre-form 20, 30 may be soaked with a solvent to increase the flexibility thereof.

Figure 7:
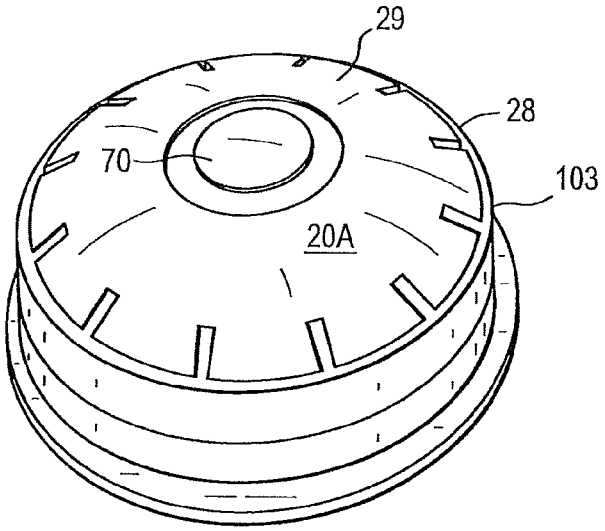
FIG. 7 is a perspective view of a formed polishing pad from the cut-out of FIG. 2 in accordance with one or more embodiments of the present invention.

FIG. 7 illustrates the formed polishing pad 20A, when the pad pre-form 20 is used in the apparatus 50. Note that there is no wrinkling at the peripheral edge 26 as was the case in the prior art. The central aperture 29 of the pad 20A allows more material flexibility, thereby reducing wrinkles. The aperture 29 also provides a feature that allows a referencing button 70 (fabricated of a material that is harder than the pad material) to be placed on the dome-shaped forming surface 104 of the bonnet 103. The button 70 is used to set the tool axis position in relation to the surface to be polished. The button 70 is used to fill the central aperture 29 and should be of like thickness to the formed polishing pad 20A. The button 70 may be of magnitudes stiffer material to prevent compression during a probing function. The probing function sets the position of the polishing pad surface relative to the part surface (the part to be polished) to be able to control the amount of polishing pressure applied to the part surface. Also the probing function will detect the geometry errors of the part surface in relation to the machine axis and allow for compensation during the polishing motions. The button 70 makes contact with the part surface at one or multiple points and machine control receives feedback from sensors in the machine axis to determine part and polish pad positions. During probing, the axis is fed into the component until an axis load cell of the polishing apparatus detects a trigger load. When the trigger load is detected, the axis position is recorded. This touch load/position sensing is used to electronically map the part surface. The harder center button 70 results in a smaller repeatability error when being used to probe the part surface. If the center button 70 were significantly compressible, it would result in a non-repeatable probe trigger load, which in turn would result in a position repeatability error. The textured polishing pad tends to result in mapping errors of several microns.

The forming apparatus 50 can also be used for gluing the formed polishing pad 20 onto a polishing bonnet 103. This is achieved by removal of the bonnet form 102 (FIG. 5-6) and installation of a polishing bonnet 103 (FIG. 7) onto the first platen 100. Adhesive is placed on the appropriate surfaces of the bonnet 103 prior to, or after mounting same onto the first platen 100. The bonnet 103, being formed of a flexible material, is inflated to a desired working pressure via a fluid fitting (port) 106 in the first platen 100. The formed polishing pad 20 is placed lightly on the bonnet 103. Next, the second platen 200 is lowered and locked in place in the same way as in the formation of the polishing pad 20 (discussed above). The pressure inside the pneumatic bladder 202 may be adjusted to evenly distribute the load and press the pad 20 in place with no wrinkles or loose adhesive zones.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A polishing pad for polishing semiconductor surfaces, comprising:

a circular body having a center and an outer peripheral edge;

a circular aperture disposed at the center of the circular body; and a plurality of slots extending from the outer peripheral edge radially towards the circular aperture, each of the plurality of slots not intersecting the circular aperture, wherein the circular aperture is configured to accept a referencing button to be placed on a bonnet, the reference button configured to set a tool axis position in relation to a semiconductor surface to be polished, wherein at least one of the plurality of slots includes a width that is substantially constant along a length of the at least one slot when the polishing pad is in a flat orientation, and wherein the plurality of slots are disposed evenly about the perimeter of the body, each at about 30 degree intervals.

2. The polishing pad of claim 1, wherein the body is in a semi-spherical, domed shape.

3. The polishing pad of claim 1, wherein at least one of:

the width of the at least one slot is about 0.1 to about 0.4 inches;

the length of the at least one slot is about 0.25 to about 0.5 inches;

the width of the at least one slot is about 20%-160% of the length of the at least one slot;

the width of the at least one slot is about 2% to about 10% of a diameter of the body; and the length of the at least one slot is about 6% to about 15% of the diameter of the body.

4. A polishing pad for polishing semiconductor surfaces, comprising:

a circular body having a center and an outer peripheral edge;

a circular aperture disposed at the center of the circular body; and a plurality of slots extending from the outer peripheral edge radially towards the circular aperture, each of the plurality of slots not intersecting the circular aperture, wherein the circular aperture is configured to accept a referencing button to be placed on a bonnet, the reference button configured to set a tool axis position in relation to a semiconductor surface to be polished, wherein at least one of the plurality of slots includes a width that tapers along a length of the least one slot from the peripheral edge toward the center when the polishing pad is in a flat orientation, and wherein the plurality of slots are disposed evenly about the perimeter of the body, each at about 60 degree intervals.

5. The polishing pad of claim 4, wherein at least one of:

the width of the at least one slot is about 0.1 to about 0.4 inches at the peripheral edge;

the length of the at least one slot is about 0.5-1.5 inches;

the at least one slot tapers to a point; and the length of the at least one slot is about 12% to about 40% of the diameter of the body.

6. The polishing pad of claim 4, wherein the body is in a semi-spherical, domed shape.

* * * * *